US008147682B2

(12) United States Patent
Lahaie et al.

(10) Patent No.: US 8,147,682 B2
(45) Date of Patent: Apr. 3, 2012

(54) BITUMEN AND THERMAL RECOVERY FROM OIL SAND TAILINGS

(75) Inventors: Rick Lahaie, Fort McMurray (CA); Simon Yuan, Fort McMurray (CA); Jim Lorentz, Fort McMurray (CA); Christian Matte, Fort McMurray (CA); Kamal Hammad, Fort McMurray (CA)

(73) Assignee: Syncrude Canada Ltd., Fort McMurray (CA)

( * ) Notice: Subject to any disclaimer, the term of this patent is extended or adjusted under 35 U.S.C. 154(b) by 794 days.

(21) Appl. No.: 11/555,046

(22) Filed: Oct. 31, 2006

(65) Prior Publication Data

US 2008/0099380 A1 May 1, 2008

(51) Int. Cl.
*C10G 1/04* (2006.01)

(52) U.S. Cl. ..... 208/425; 208/390; 208/391; 208/424

(58) Field of Classification Search ..... 208/390, 208/391, 424, 425, 426
See application file for complete search history.

(56) References Cited

U.S. PATENT DOCUMENTS

| | | | | |
|---|---|---|---|---|
| 4,533,459 | A * | 8/1985 | Dente et al. | 208/391 |
| 4,678,558 | A * | 7/1987 | Belluteau et al. | 208/390 |
| 4,828,688 | A * | 5/1989 | Corti et al. | 208/391 |
| 6,004,455 | A | 12/1999 | Rendall | |
| 6,007,708 | A | 12/1999 | Allcock et al. | |
| 6,019,888 | A * | 2/2000 | Mishra et al. | 208/341 |
| 2005/0150844 | A1 * | 7/2005 | Hyndman et al. | 210/750 |

FOREIGN PATENT DOCUMENTS

| | | |
|---|---|---|
| CA | 1263331 | 11/1989 |
| CA | 2098656 | 12/1994 |
| CA | 2188064 | 4/1998 |
| CA | 2208767 | 12/1998 |
| CA | 2217623 | 4/1999 |
| CA | 2246841 | 3/2000 |
| CA | 2350907 | 5/2000 |
| CA | 2454942 | 7/2005 |

OTHER PUBLICATIONS

R.L. George, Mining for Oil, 1998, Scientific American, 278 (3), p. 84-85.*

* cited by examiner

*Primary Examiner* — Walter D Griffin
*Assistant Examiner* — Renee E Robinson
(74) *Attorney, Agent, or Firm* — Bennett Jones LLP

(57) ABSTRACT

A process and process line is provided for recovering heat in the form of cleaned warm water and residual bitumen from oil sand tailings produced during an oil sands extraction process. The process includes removing at least a portion of the coarse solids from the oil sand tailings to produce a reduced solids tailings fraction; separating at least a portion of the bitumen from the reduced solids tailings fraction to produce a bitumen fraction and a warm water and fines fraction; and removing at least a portion of the fines from the warm water and fines fraction to produce cleaned warm water and a concentrated fines fraction. The cleaned warm water can then be reused in the oil sands extraction process.

22 Claims, 2 Drawing Sheets

BITUMEN AND THERMAL RECOVERY FROM OIL SAND TAILINGS

FIELD OF THE INVENTION

The present invention relates generally to a process and a process line for recovering residual bitumen and heat from oil sand tailings produced during an oil sands extraction process.

BACKGROUND OF THE INVENTION

Oil sand, such as is mined in the Fort McMurray region of Alberta, Canada, generally comprises water-wet sand grains held together by a matrix of viscous bitumen. It lends itself to liberation of the sand grains from the bitumen, preferably by slurrying the oil sand in heated water, allowing the bitumen to move to the aqueous phase.

For many years, the bitumen in McMurray oil sand has been commercially recovered using a hot water process well known in the art. Generally, oil sand is mixed in a tumbler with hot water having a temperature of approximately 80-90° C., steam, caustic (e.g., sodium hydroxide) and naturally entrained air to yield a slurry having a temperature typically around 80° C. The slurry so produced is diluted with additional hot water to produce diluted slurry having a temperature of about 65° C. to about 80° C. The diluted slurry is introduced into a large, open-topped, conical-bottomed, cylindrical vessel termed a primary separation vessel (PSV) where the more buoyant aerated bitumen rises to the surface and forms a froth layer.

However, while the hot water process assured good bitumen recoveries for all grades of oil sand, the thermal energy requirement per tonne of oil sand processed for the steam production and for heating hot flood water is very high.

Recently, in an attempt to reduce the thermal energy requirement for bitumen extraction from oil sands, a low energy extraction process or the "LEE process" for bitumen extraction was developed, which is generally described in Canadian patent No. 2,217,623 and U.S. Pat. No. 6,007,708. The LEE process generally comprises the following steps:

- dry mining the oil sand;
- mixing the mined oil sand with water in predetermined proportions near the mine site to produce a slurry containing entrained air and having a controlled density in the range of about 1.4 to about 1.65 g/cc and preferably a temperature in the range of about 20° C. to about 50° C. or higher;
- pumping the slurry through a pipeline having a plurality of pumps spaced along its length, preferably adding air to the slurry as it moves through the pipeline, to condition the slurry (i.e., ablating the larger lumps of oil sand to release bitumen and allowing the bitumen flecks to coalesce and attach to air bubbles);
- diluting the conditioned slurry with flood water and introducing the diluted slurry into a primary separation vessel (PSV) to float the aerated bitumen and separate it from the middlings and tailings (primary tailings). The froth is maintained at a temperature of at least 35° C. in the PSV by use of a heated water underwash to optimize separation of the bitumen. Primary tailings, primarily comprising coarse solids, water, and residual bitumen, which settle to the bottom of the PSV and secondary tailing primarily comprising fines, water, and residual bitumen, which are produced from the further processing of the PSV middlings in flotation cells to remove bitumen still remaining in the middlings, are disposed of accordingly.

While the thermal energy requirements of the hot water process are significantly reduced in the LEE process, nevertheless, thermal energy in the form of heated flood water is still required for slurry preparation, slurry dilution and for the PSV underwash to ensure the overall PSV slurry temperature of at least 35° C.

Finding sources of thermal energy for the LEE process, however, becomes problematic as oil sands mining and extraction operations are being located at considerable distances away from upgraders such as cokers, which are an economical source of thermal energy. These satellite oil sands operations still require considerable supplemental heat input to achieve the targeted bitumen recoveries. Thus, the heat input comes predominantly from natural gas delivered through a gas turbine operated with auxiliary burning as well as by utilizing natural gas fired auxiliary boilers.

Currently, both the heat (thermal energy) and any residual bitumen present in the primary and secondary tailings are lost in the tailings deposition process. In fact, using optimum LEE process conditions still results in only about 90 to about 94% bitumen recovery depending on the ore blend, pipeline conditioning and recycle water chemistry. Thus, it would be beneficial, both from an energy conservation and an improved bitumen recovery point of view, to capture the heat and bitumen in tailings.

Thus, there is a need for a process that can be used for both bitumen and heat recovery from oil sand tailings.

SUMMARY OF THE INVENTION

The present invention relates to a process and a process line for recovering residual bitumen and heat from oil sand tailings produced during an oil sands extraction process. The present invention is of particular importance when a low energy extraction process such as the LEE process described above is used for bitumen extraction at sites relatively remote from readily accessible sources of heat. However, it is understood that the present invention can be used with any oil sand extraction process including those that use extraction temperatures higher than those used in the LEE process.

As described above, bitumen present in oils sands is extracted from oil sands by first forming an oil sand slurry with either hot or warm water. Oil sand slurry is then conditioned either in a tumbler or more recently by pumping the slurry through a pipeline. Primary separation of bitumen from solids present in oil sand slurry may occur in large capacity gravity settlers called primary separation vessels (PSVs), where the slurry is divided into primary bitumen froth, middlings (primarily comprised of warm water, fines and bitumen) and coarse tailings (primarily comprised of coarse solids, warm water, and residual bitumen), which are generally referred to as primary tailings.

The bitumen still remaining in the middlings fraction is often recovered in flotation cells where air is added and further separation of bitumen from solids occurs. The tailings that are separated during flotation are commonly referred to as secondary tailings and are primarily comprised of fines, warm water and residual bitumen. The present invention can be used to recover heat and bitumen from either primary tailings, secondary tailing or, preferably, from pooled primary and secondary tailings ("pooled tailings").

It is understood that the present invention can be used on any oil sand tailings produced as a result of the separation of bitumen from solids present in an oil sand slurry. For example, separation means other than a PSV can be used to separate bitumen from solids, thereby producing oil sand tailings, for example, cycloseparators as described in CA 2,246,841 or incline plate settlers or a combination of cycloseparators and inclined plate settlers.

Thus, in accordance with one aspect of the invention, a process is provided for recovering heat in the form of cleaned warm water and residual bitumen from oil sand tailings produced during an oil sands extraction process, said oil sand tailings including coarse solids, warm water, fines and bitumen, comprising:

removing at least a portion of the coarse solids from the oil sand tailings to produce a coarse solids fraction and a reduced solids tailings fraction primarily including fines, warm water and bitumen;

separating at least a portion of the bitumen from the reduced solids tailings fraction to produce a bitumen fraction and a warm water and fines fraction; and removing at least a portion of the fines from the warm water and fines fraction to produce cleaned warm water and a concentrated fines fraction.

By "oil sand tailings" is meant any solids fraction obtained after the separation of bitumen from the solids present in oil sand slurry and includes primary tailings, secondary tailings and pooled tailings.

By "fines" is meant particles such as fine quartz and other heavy minerals, colloidal clay or silt generally having any dimension less than about 44 μm.

By "coarse solids" is meant solids generally having any dimension greater that about 44 μm.

In general, the concentrated fines fraction includes particles such as fine quartz and other heavy minerals, colloidal clay or silt generally having a nominal average dimension of about 100 μm.

Preferably, the cleaned warm water produced by the present invention has less than 2 wt % total solids, more preferably less than 1 wt % total solids, and most preferably less than 0.5 wt % solids, and has a temperature between about 20° C. to about 50° C. or higher.

In one embodiment, the heat present in the cleaned warm water can be used for oil sands extraction. More particularly, in one embodiment, the cleaned warm water can be used to prepare oil sand slurry. In another embodiment, the cleaned warm water can be used to dilute oil sand slurry prior to separating the bitumen from the solids present in the oil sand slurry, for example, in a PSV. In another embodiment, the cleaned warm water can be added directly to the Utilities water heating infrastructure for thermal conservation. Thus, the heat present in the cleaned warm water is conserved thereby reducing the overall thermal energy that needs to be supplied from external sources.

In one embodiment, the concentrated fines fraction that is removed from the warm water and fines fraction is deposited in a tailings disposal site.

In one embodiment, coarse solids are removed from the oil sand tailings by means of one or more screen. In another embodiment, coarse solids are removed from the oil sand tailings by means of one or more hydrocyclone. In yet another embodiment, coarse solids are removed by means of a combination of one or more screen for removing the larger coarse solids and one or more hydrocyclone for removing the smaller coarse solids.

In one embodiment, the bitumen is separated from the reduced solids tailings fraction by means of one or more flotation device, wherein the bitumen floats to the top of the flotation device to produce the bitumen fraction, leaving behind the warm water and fines fraction. In one embodiment, the flotation device is a flotation cell. In another embodiment, other flotation devices known in the industry can be used, for example, but not limited to, any mineral flotation device such as a Jameson Cell™, a contact flotation cell, a mechanical flotation cell, a Tailings Oil Recovery Vessel (TORV) or a flotation column.

In one embodiment, the fines are removed from the warm water and fines fraction to produce cleaned warm water by feeding the warm water and fines fraction into one or more thickener having a substantially shallow sloped bottom and allowing the fines to settle on the substantially shallow sloped bottom to form the concentrated fines fraction. In a preferred embodiment, a processing aid is added to the thickener such as a flocculant, a coagulant or a combination of both to aid in the settling of the fines. The coagulant is preferably a cationic coagulant. Suitable flocculants are well known in the art and include polyacrylamide. Suitable coagulants are well known in the art and include polyamine, gypsum, lime, alum or any combination thereof.

In one embodiment, the coarse solids fraction is mixed with the concentrated fines fraction and gypsum is added to the mixture to produce composite tailings.

In one embodiment, the process further comprises cleaning the bitumen fraction in a froth cleaner to produce a cleaned bitumen overflow and a froth cleaner underflow. In another embodiment, the process further comprises mixing the froth cleaner underflow with the oil sand tailings. In yet another embodiment, the process further comprises mixing the froth cleaner underflow with the reduced solids tailings fraction.

In accordance with another aspect of the invention, a process is provided for recovering bitumen and heat from a conditioned oil sand slurry, comprising:

introducing the conditioned oil sand slurry into a primary separation vessel to form a top layer of bitumen froth, a middle layer of middlings including primarily warm water, fines and residual bitumen and a bottom layer of primary tailings including primarily coarse solids, warm water and residual bitumen;

delivering the middlings to one or more primary flotation device to remove at least a portion of the residual bitumen from the middlings to produce a secondary bitumen froth and secondary tailings including primarily fines, warm water and residual bitumen;

mixing the secondary tailings with the primary tailings to produce a pooled tailings fraction;

screening out at least a portion of larger coarse solids from the pooled tailings fraction to produce a screened tailings fraction;

feeding the screened tailings fraction to one or more hydrocyclone to remove at least a potion of smaller coarse solids to produce a smaller coarse solids fraction and a reduced solids tailings fraction primarily including fines, warm water and bitumen;

delivering the reduced solids tailings to one or more secondary flotation device to separate at least a portion of the bitumen from the reduced solids tailings fraction to produce a bitumen fraction and a warm water and fines fraction; and feeding the warm water and fines fraction into one or more thickener to remove at least a portion of the fines from the warm water and fines fraction to produce cleaned warm water and a concentrated fines fraction.

In one embodiment, the process further comprises delivering the cleaned warm water back to the primary separation vessel. In another embodiment, the process further comprises mixing the warm water with conditioned oil sand slurry prior to introducing the conditioned oil sand slurry into the primary separation vessel.

In one embodiment, the process further comprises introducing the bitumen fraction into one or more froth cleaner to produce a tertiary bitumen froth and a froth cleaner underflow. In a further embodiment, the process further comprises mixing the froth cleaner underflow with the pooled tailings fraction prior to screening.

In one embodiment, the smaller coarse solids fraction is mixed with the concentrated fines fraction and gypsum is added to the mixture to produce composite tailings.

In accordance with another aspect of the invention, a process line for recovering heat in the form of cleaned warm water and recovering residual bitumen from oil sand tailings produced during an oil sands extraction process, said oil sand tailings comprising coarse solids, fines, warm water and bitumen, said process line comprising:

- one or more hydrocyclone for removing at least a portion of the coarse solids in the oil sand tailings to produce a reduced solids tailings fraction including primarily fines, warm water and bitumen;
- one or more flotation device for receiving the reduced solids tailings fraction and separating out the bitumen from the warm water and fines to produce a bitumen fraction and a warm water and fines fraction; and
- one or more thickener for receiving the warm water and fines fraction and facilitating the settling of the fines to form cleaned warm water and a concentrated fines fraction.

In one embodiment, the process line further comprises one or more screen to remove larger coarse solids prior to introducing the oil sand tailings into the hydrocyclones.

In another embodiment, the process line further comprises a froth cleaner for receiving the bitumen fraction to produce a cleaned bitumen overflow and a froth cleaner underflow.

In one embodiment, the thickener has a substantially flat bottom. In another embodiment, the thickener has a rake, such that as the rake moves through the sludge, it provides channels for the liquid supernatant to move upward as the solids settle downward.

When particularly used with the LEE process, the present invention results in an increase in overall bitumen recovery to greater than 95% and a warm water recovery commensurate with the anticipated warm water needs but generally greater than 25%. Furthermore, use of a thickener to facilitate the settling of fines, in particular, in the presence of a flocculant and/or a coagulant results in more compact tailings that are easier to dispose.

DESCRIPTION OF THE PREFERRED EMBODIMENT

The present invention is exemplified by the following description. This embodiment of the present invention is described for recovering heat and residual bitumen from pooled primary and secondary tailings.

Figure 1:
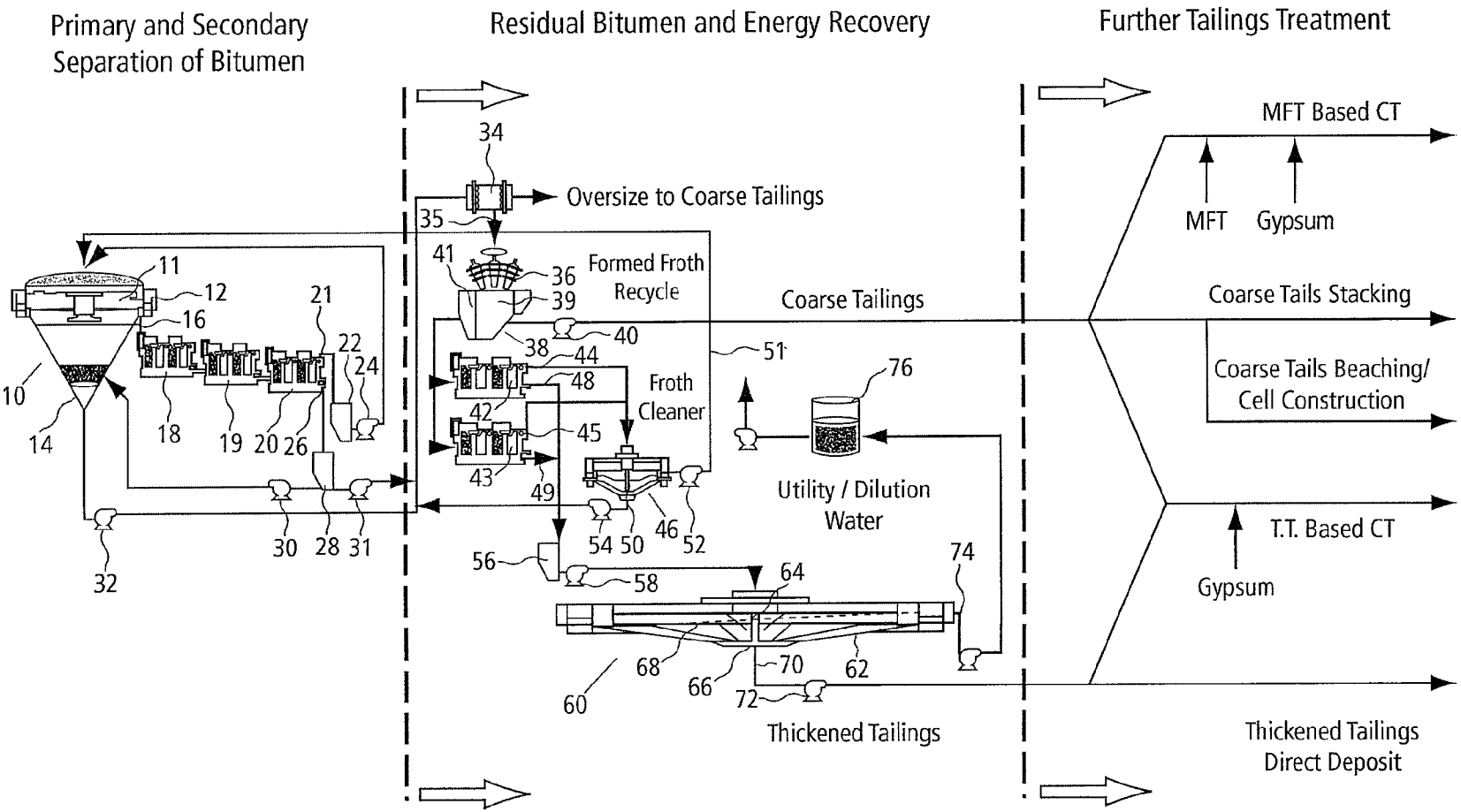
FIG. 1 is a schematic setting forth the process in accordance with an embodiment of the invention.

A schematic of an inline or in series process of the present invention is shown in FIG. 1. Conditioned oil sand slurry, for example, slurry produced by the LEE process and conditioned in a pipeline, is fed into primary separation vessel (PSV) 10 and allowed to separate under quiescent conditions into a top layer of bitumen froth 11, commonly referred to in the art as "primary froth", a middle layer of middlings 16, including primarily warm water, fines and residual bitumen, and a bottom layer of coarse tailings 14, including primarily coarse solids, warm water and residual bitumen, which are commonly referred to in the art as "primary tailings".

Bitumen froth 11 is typically removed from the PSV via launder 12 and collected for further upgrading by upgrading processes known in the art. Middlings layer 16 is removed from PSV 10 and at least a portion of the residual bitumen still remaining in the middlings fraction may be recovered in a series of primary flotation cells (often collectively referred to as the primary flotation circuit) where air is added to the cells and the residual bitumen floats to the top of the primary flotation cells to form primary flotation cell overflow. FIG. 1 shows a series of three flotation cells 18, 19, 20 whereby the underflow from the previous flotation cell is fed into the flotation cell next in line. For example, as shown in FIG. 1, the underflow from flotation cell 18 is fed into flotation cell 19 and the underflow from flotation cell 19 is fed into flotation cell 20. Primary flotation cell overflow 21 from the last flotation cell 20, which is commonly referred to in the art as secondary froth, is removed into pump box 22 and may be recycled back via pump 24 to PSV 10. In the alternative, the secondary froth can be further cleaned by cleaning processes known in the art.

The primary flotation cell underflow 26 from the last in the series of flotation cells, e.g., flotation cell 20, is commonly referred to in the industry as "secondary tailings" and is conventionally transported to sand disposal site. However, in the present embodiment of the invention, the secondary tailings are removed to pump box 28 and then either pumped via pump 30 and returned to the PSV 10 into the bottom layer of primary tailings 14 or pumped via pump 31 and pooled with primary tailings 14 that have been removed from the PSV via pump 32. The primary and secondary tailings can be pooled in a pump box or tailings distributor (not shown), a mixing tank, a pipeline or the like. On average, the pooled primary and secondary tailings (hereinafter referred to as "pooled tailings") will have a temperature in the range of about 30° to about 50° C., usually around 35° C.

The residual bitumen and energy (in the form of warm water) contained in the pooled tailings are recovered as follows. In the present embodiment, the pooled tailings are first screened using screen 34 to remove the larger coarse solids present in the pooled tailings in order to protect the hydrocyclones that are used to remove smaller coarse solids. Screen 34 reduces the size of the coarse solids in the pooled tailings from about 5" down to possibly as small as about 1" in any dimension. Thus, the larger sized solids such as stones, charcoal and the like are removed and disposed of accordingly. It is understood that more than one screen can be used at this step to accommodate larger volumes of pooled tailings. In another embodiment, the screens can be replaced with one ore more larger cyclones that are specifically designed to remove solids larger than 2".

The screened pooled tailings stream 35 is then fed to one or more hydrocyclones 36 (e.g., hubs of hydrocyclones) to further remove smaller coarse solids (e.g., sand). A hydrocyclone overflow comprising primarily bitumen, fines and warm water (generally containing about 80 wt % of the water) and a hydrocyclone underflow of coarse solids or tailings (generally containing about 20 wt % of the water) are produced in hydrocyclones 36.

The hydrocyclone underflow of primarily smaller coarse solids can generally be disposed of in one of two ways. First, the cyclone underflow is delivered into compartment 39 of pump box 38 where it can be diluted with cold water to form a pumpable coarse solids slurry that can be pumped via pump 40 to tailings disposal sites. Alternatively, a coagulant such as gypsum can be added to the cyclone underflow, along with thickener 60 underflow 70 (discussed in more detail below) or Mature Fine Tailings ("MFT") produced in previously existing oil sand tailings disposal sites, present in pump box 38 instead of cold water to form "composite tailings" or "CT", so called because a non-segregated mixture is formed due to the fines being interspersed between the coarse solids. This high density mixture can then be pumped to appropriate disposal sites.

The hydrocyclone overflow, which primarily contains up to about 80 wt % of the water plus fines and bitumen, can be further treated to separate out the valuable bitumen and to capture the heat present in the cyclone overflow in the form of substantially clean reusable warm water. Hydrocyclone overflow is added to one or more high energy air and slurry contact cells, such as a flotation cell as known in the art. It is understood that other aerated separation means or flotation devices known in the industry can be used, for example, but not limited to, any mineral flotation device such as a Jameson Cell™, a contact flotation cell, a mechanical flotation cell, a Tailings Oil Recovery Vessel (TORV) or a flotation column. It is also understood that more than one secondary flotation cell may be used. In FIG. 1, two flotation cells 42 and 43 are shown Overflow from hydrocyclone 36 is fed into compartment 41 of pump box 38 and then fed to one or both flotation cells 42 and 43 where a portion of the residual bitumen floats to the top to form bitumen fractions 44 and 45, respectively. Bitumen fractions 44 and 45 can be further cleaned in froth cleaner 46. In froth cleaner 46, bitumen rises to the top to form froth cleaner overflow, or "tertiary bitumen froth", which contains substantially cleaned bitumen. Tertiary bitumen froth 51 can be recycled back to PSV 10 via pump 52 to knock out any solids still remaining therein. In the alternative, tertiary froth can be further upgraded by upgrading processes known in the art.

Froth cleaner 46 is typically a gravity separator having a shallow cone end and a rake at the bottom of the cone for further concentrating the bitumen froth by releasing any entrapped solids and water. The froth cleaner underflow 50 can be recycled back via pump 54 to either screen 34, hydrocyclone 36 or back to secondary flotation cells 42 and 43 for further treatment to recover any further residual bitumen.

In other embodiments, bitumen fractions 44 and 45 could go directly to PSV 10 without further cleaning in froth cleaner 46.

The secondary flotation cell underflows 48 and 49, which underflows contain mostly warm water and about 10 to 15 wt % solids, are collected in pump box 56 and pumped via pump 58 to one or more thickeners 60. Thickener 60 comprises a substantially shallow sloped bottom 62 and heavy-duty rake drive mechanism 64 to move the settled tailings or sludge to the centre outlet 66. Thickener 60 is an efficient method to gravity concentrate a substantial portion of fines from the hydrocyclone overflow into thickener underflow. The rake 68, as it moves through the sludge, provides channels for the liquid supernatant to move upward as the solids settle downward. The thickener underflow 70, which underflow is also referred to herein as concentrated fines fraction or thickened tailings ("TT"), is pumped via pump 72 for disposal, or to the hydrocyclone underflow compartment 39 of pump box 38 for making a non-segregated mixture of coarse solids and fines (CT).

In one embodiment, a flocculant and/or a coagulant can be added to the secondary flotation cell underflows 48 and 49 prior to feeding the underflow to the thickener 60 to improve thickening of the solids. Suitable flocculants or coagulants include, but are not limited to, polyacrylamide, polyamine, gypsum, lime, alum or combinations thereof. The thickener overflow 74 comprises substantially clean, high quality warm water 76 having less than about 2 wt % total solids, preferably less than 1.0 wt % solids, most preferably less than 0.5 wt % total solids. This warm water can thus be reused in the oil sand extraction process thereby conserving energy and helping meeting the heated water demands of the LEE process. In particular, warm water 76 can be used in oil sand slurry preparation. In the alternative, or in addition, warm water 76 can be used to dilute conditioned oil sand slurry prior to introducing it into the PSV. In the further alternative, or in addition, warm water 76 can be used as PSV underwash. Finally, the warm water, if not of sufficient quality, can be used in a heat exchanger for efficient heat transfer to a more suitable process water stream.

Various tailings fractions produced from the overall process described above can be further treated and/or disposed of as follows. As previously mentioned, hydrocyclone tailings/tails or coarse tailings/tails can be treated in one of two ways. The coarse tailings can be diluted with cold water and disposed of in various tailings disposal sites. In one embodiment, the diluted coarse tailings can be further treated in stacking cyclones for dewatering and the dewatered coarse tailings used for deck construction or cell construction, as is known in the art. In another embodiment, the diluted coarse tailings are pumped directly to tailings disposal sites where the coarse sand settles out on the beach and the fines/water flow by gravity to a lower elevation and colleted therein (referred to as "coarse tails beaching"). In a further embodiment, MFTs that are produced in existing tailings disposal sites can be added to the coarse tailings and gypsum added thereto to form CT.

The thickener underflow 70, which underflow is also referred to herein as concentrated fines fraction or thickened tailings (TT), can also be pumped back to compartment 39 of pump box 38, mixed with the hydrocyclone tailings and treated with gypsum to produce Composite Tailings as described above. In the alternative, the TT can be directly deposited into tailings disposal sites.

Figure 2:
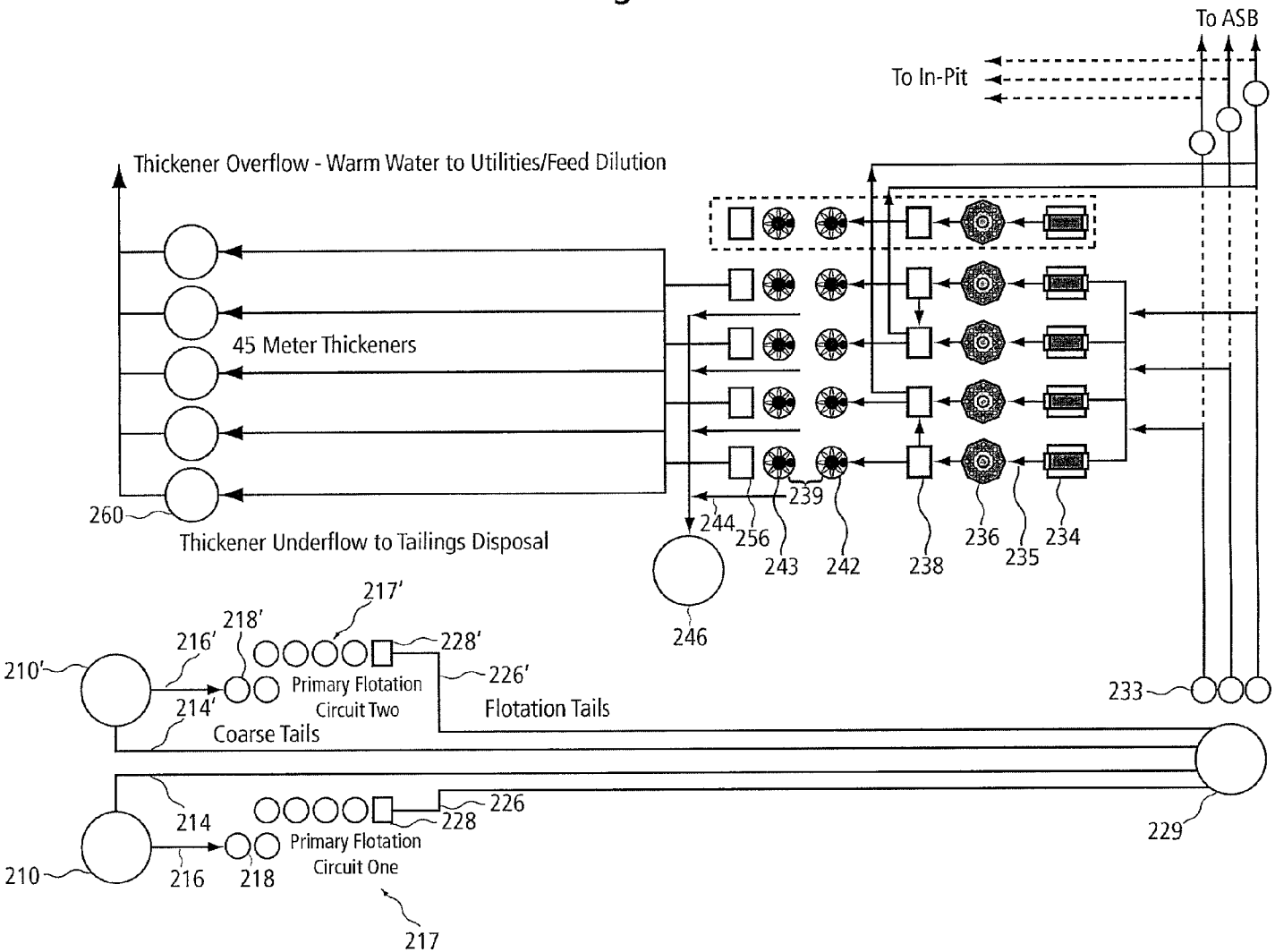
FIG. 2 is a schematic showing the process line of an embodiment of the present invention.

A process line of an embodiment of the present invention is now described with reference to FIG. 2. In the embodiment shown in FIG. 2, two PSVs 210, 210' are used for separating out primary bitumen froth from conditioned oil sand slurry. It is understood that the process line may include more than two PSVs or only one PSV. Middlings 216 and 216', respectively, from each PSV are fed into primary flotation circuits 217 and 217'. Primary flotation circuit 217 is comprised of a plurality of flotation cells 218, in series, and primary flotation circuit 217' is also comprised of a plurality of flotation dells 218', in series. The underflow from one flotation cell is fed to the next in line flotation cell. The flotation cell underflow from the last in line flotation cell of each primary flotation circuit is then removed into pump box 228, 228', respectively, to form secondary tailings 226, 226'.

Coarse tailings or primary tailings 214, 214' are removed from PSVs 10, 10', respectively, and pumped into tailings distributor 229. Secondary tailings 226, 226'are also pumped into tailings distributor 229, which along with primary tailings 214, 214' form pooled tailings. Alternatively, streams 214, 214' and 226, 226' can be processed separately as non-pooled tailings. Pooled or non-pooled tailings are pumped via at least one pump 233 into at least one screen 234, where the larger coarse solids (i.e., greater than 2" in any dimension) are removed. The screened pooled tailings 235 are then fed into at least one hydrocyclone 236 for removal of smaller coarse solids thereby primarily leaving behind solids having a nominal average dimension of about 100 μm in the hydrocyclone overflow.

The underflow from the hydrocyclone 236 (i.e., comprising the smaller coarse solids) is collected in at least one pump box 238, where it is either diluted with cold water prior to being pumped for disposal or gypsum along with MFT or TT are added to thicken the underflow to form non-segregating or composite tailings before disposal. The overflow from hydrocyclone 236 is then fed into at least one secondary flotation circuit 239, each secondary flotation circuit comprising two flotation cells 242, 243. Flotation cell overflow, or bitumen fraction 244, may be further treated in froth cleaner 246 as described above. Flotation cell underflow, comprising primarily warm water and fines are first contained in at least one pump box 256 and pumped to at least one thickener 260. Thickener underflow, i.e., thickened tailings or concentrated fines fraction, is deposited in tailings disposal sites or sent to pump box 238 to form non-segregating tailings. Thickener overflow, i.e., cleaned warm water, is then used in utilities or for PSV feed dilution as previously described.

The embodiments of the invention in which an exclusive property or privilege is claimed are defined as follows:

1. A process for recovering heat in the form of cleaned warm water and residual bitumen from oil sand tailings produced during an oil sands extraction process, said oil sand tailings including coarse solids, warm water, fines and bitumen, comprising the following steps in series:

screening out at least a portion of larger coarse solids from the oil sand tailings to produce a screened tailings fraction;

feeding the screened tailings fraction to at least one hydrocyclone to remove at least a portion of smaller coarse solids to produce a smaller coarse solids fraction comprising about 20 wt % of the warm water and a reduced solids tailings fraction comprising fines, bitumen and about 80 wt % of the warm water;

separating the reduced solids tailings fraction into no more than two fractions, a bitumen fraction and a warm water and fines fraction, by subjecting the reduced solids tailings fraction to at least one flotation device; and removing at least a portion of the fines from the warm water and fines fraction in at least one thickener to produce cleaned warm water and a concentrated fines fraction.

2. The process as claimed in claim 1, wherein the cleaned warm water comprises less than 2% by weight total solids.

3. The process as claimed in claim 1, wherein the cleaned warm water comprises less than 1% by weight total solids.

4. The process as claimed in claim 1, wherein the cleaned warm water comprises less than 0.5% by weight total solids.

5. The process as claimed in claim 1, further comprising:

using the cleaned warm water in the oil sands extraction process where warm water is needed.

6. The process as claimed in claim 1, further comprising:

depositing the concentrated fines fraction in a tailings disposal site.

7. The process as claimed in claim 1, further comprising:

mixing the coarse solids fraction with the concentrated fines fraction and gypsum to produce composite tailings.

8. The process as claimed in claim 1, further comprising:

adding a flocculant, a coagulant, or both to the warm water and fines fraction prior to removing at least a portion of the fines in the at least one thickener.

9. The process as claimed in claim 1, the at least one thickener having a substantially shallow sloped bottom.

10. The process as claimed in claim 1, further comprises:

cleaning the bitumen fraction in a froth cleaner to produce a cleaned bitumen overflow and a froth cleaner underflow.

11. The process as claimed in claim 10, further comprises:

mixing the froth cleaner underflow with either the oil sand tailings, the reduced solids tailings fraction, or both.

12. The process as claimed in claim 1, wherein the oil sand tailings are primary tailings, secondary tailings or a mixture of primary and secondary tailings.

13. The process as claimed in claim 1, wherein the oil sands extraction process is a low energy extraction process.

14. A. process for recovering heat and bitumen from a conditioned oil sand slurry, comprising the following steps in series:

introducing the conditioned oil sand slurry into a primary separation vessel to foam a top layer of primary bitumen froth, a middle layer of middlings including primarily warm water, fines and residual bitumen and a bottom layer of primary tailings including primarily coarse solids, warm water and residual bitumen;

delivering the middlings to one or more primary flotation device to separate at least a portion of the bitumen from the warm water and fines to produce a secondary bitumen froth and secondary tailings including primarily fines, warm water and bitumen;

mixing the secondary tailings with the primary tailings to produce a pooled tailings fraction;

screening out at least a portion of larger coarse solids from the pooled tailings fraction to produce a screened tailings fraction;

feeding the screened tailings fraction to one or more hydrocyclone to remove at least a portion of smaller coarse solids to produce a smaller coarse solids fraction comprising about 20 wt % of the warm water and a reduced solids tailings fraction including primarily fines, about 80 wt % of the warm water and bitumen;

delivering the reduced solids tailings to one or more secondary flotation device to separate the reduced solids tailings fraction into no more than two fractions to produce a bitumen fraction and a warm water and fines fraction; and feeding the warm water and fines fraction into one or more thickener to remove at least a portion of the fines from the warm water and fines fraction to produce cleaned warm water and a concentrated fines fraction.

15. The process as claimed in claim 14, further comprising:

mixing the smaller coarse solids fraction with the concentrated fines fraction and gypsum to produce composite tailings.

16. The process as claimed in claim 14, further comprising:

introducing the bitumen fraction into one or more froth cleaner to produce a tertiary bitumen froth and a froth cleaner underflow.

17. The process as claimed in claim 16, further comprising:

mixing the froth cleaner underflow with the pooled tailings fraction prior to screening.

18. The process as claimed in claim 16, whereby the primary bitumen froth, the secondary bitumen froth and the tertiary bitumen froth account for at least 95% of the bitumen in the conditioned oil sand slurry.

19. The process as claimed in claim 14, further comprising:

delivering the cleaned warm water back to the primary separation vessel.

20. The process as claimed in claim 14, further comprising: mixing the cleaned warm water with the conditioned oil sand slurry prior to introducing the conditioned oil sand slurry into the primary separation vessel.

21. The process as claimed in claim 14, whereby the conditioned oil sand slurry is prepared using a low energy extraction process.

22. The process as claimed in claim 14, whereby the one or more secondary flotation device is selected from the group consisting of a Jameson Cell™, a contact flotation cell, a mechanical flotation cell, a Tailings Oil Recovery Vessel (TORV), a flotation column and any combination thereof.

* * * * *